US008408830B2

(12) United States Patent
Ogata et al.

(10) Patent No.: US 8,408,830 B2
(45) Date of Patent: Apr. 2, 2013

(54) IMAGE FORMING APPARATUS

(75) Inventors: Satoshi Ogata, Hachioji (JP); Jun Onishi, Hino (JP); Shinpei Kawasaki, Hiratsuka (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 642 days.

(21) Appl. No.: 12/328,869

(22) Filed: Dec. 5, 2008

(65) Prior Publication Data

US 2009/0154975 A1 Jun. 18, 2009

(30) Foreign Application Priority Data

Dec. 12, 2007 (JP) ..... 2007-320324

(51) Int. Cl.
*G03G 15/00* (2006.01)
*B65H 7/10* (2006.01)
*B41J 29/38* (2006.01)

(52) U.S. Cl. ..... 400/633; 399/394

(58) Field of Classification Search ..... 399/394, 399/395, 388, 301; 400/633, 579, 630, 633.2; 271/227, 228, 248, 249, 250; *B65H 07/08, B65H 07/10*

See application file for complete search history.

(56) References Cited

U.S. PATENT DOCUMENTS 6,647,884 B1 11/2003 La Vos et al.
7,266,335 B2 * 9/2007 Van Den Berg et al. ..... 399/309
2004/0046313 A1 * 3/2004 Herrmann et al. ..... 271/226
2007/0023995 A1 * 2/2007 Onodera ..... 271/226
2007/0132176 A1 * 6/2007 Kawata ..... 271/220

FOREIGN PATENT DOCUMENTS

JP 64-008159 A 1/1989
JP 01-192649 A 8/1989
JP 04-277150 A 10/1992
JP 2001-180845 A 7/2001
JP 2002-338088 A 11/2002
JP 2003-263090 A 9/2003
JP 2006-347644 A 12/2006

OTHER PUBLICATIONS

Japanese Office Action dated Nov. 22, 2011 (and English translation thereof) in counterpart Japanese Application No. 2007-320324.

* cited by examiner

*Primary Examiner* — Matthew G Marini
*Assistant Examiner* — Ruben Parco, Jr.
(74) *Attorney, Agent, or Firm* — Holtz, Holtz, Goodman & Chick, P.C.

(57) ABSTRACT

An image forming apparatus includes a moving roller capable of axial movement; a medium end position detecting section for detection in the main scanning direction; and a control section for calculating the amount of misalignment of the medium from the detected end position; wherein the control section obtains the correction amount of the image forming position of the medium according to the amount of misalignment of the medium having been calculated, or the amount of misalignment of the medium and information of moving position of the roller, and provides control such that the medium or another medium coming later than the medium by a predetermined number of pages is moved by the moving roller by the difference between the correction amount of the image forming position and the amount of misalignment of the target medium, and the image forming position is corrected according to the correction amount.

23 Claims, 7 Drawing Sheets

CONTROL BY USING ONLY END DETECTION VALUE

CONTROL BY USING END DETECTION VALUE AND ROLLER POSITION (RATIO OF 1 : 0.1)

IMAGE FORMING APPARATUS

This application is based on Japanese Patent Application No. 2007-320324 filed on Dec. 12, 2007 in Japanese Patent Office, the entire content of which is hereby incorporated by reference.

BACKGROUND OF THE INVENTION

The present invention relates to an image forming apparatus that forms an image on a medium according to image data.

In an image forming apparatus such as a photocopier, facsimile, printer, and multi-functional peripheral provided with functions of a plurality of these devices, a latent image is written onto the image carrier (such as a photoreceptor) by the LD (Laser Diode) and others in conformity to the image data. This is developed by toner, and the toner image having been obtained is transferred onto a medium directly or through an intermediate transfer body, whereby an image is formed. The medium is mounted on a sheet feed tray inside or outside the image forming apparatus. This medium is conveyed and supplied for the image formation. The front end of the medium is detected by a front end detecting sensor or the like, and the image forming position on the medium is adjusted in conformity to the timing of the detection.

Incidentally, when the medium is conveyed, position shift may occur to the medium in the direction perpendicular to the direction of conveyance. If image formation is performed under this condition, an image of poor positioning accuracy will be produced. To avoid this, the end position in the main scanning direction of the medium being conveyed is detected by an uneven-distribution sensor or the like to find out the amount of misalignment. The position for image formation is corrected in conformity to this misalignment of paper.

In this case, the main scanning direction of the medium means a direction on the medium, which is equivalent to the main scanning direction of forming a latent image of an image, at the moment of transferring the image to the medium.

To implement this method, the amount of misalignment of paper must be detected before starting image Formation. However, the tandem color image forming apparatus or the like requires a longer time for image formation than the black-and-white image forming apparatus. With this time taken into account, the end position of paper in the main scanning direction must be detected somewhat far upstream of the image forming section. Further, in the black-and-white image forming apparatus as well, the end position of paper is detected at some distance upstream of the image forming section, with consideration given to the time required for image formation. However, as detection is performed at a greater distance from the image forming section, there will be a greater possibility of misalignment caused by subsequent conveyance. This reduces the position accuracy of the image formation.

To solve this problem, proposals have been made to install a device for moving paper in the main scanning direction, and to move the paper in response to the amount of misalignment of paper in the main scanning direction, whereby the image forming position is adjusted (Japanese Unexamined Patent Application Publication No. 2002-338088, Japanese Unexamined Patent Application Publication No. 01-192649, Japanese Unexamined Patent Application Publication No. 04-277150, Japanese Unexamined Patent Application Publication No. 2003-263090, and Japanese Unexamined Patent Application Publication No. 64-8159). A reference plate called a lateral registration plate is generally used in the image forming apparatus disclosed in the Japanese Unexamined Patent Application Publication No. 2002-338088, Japanese Unexamined Patent Application Publication No. 01-192649, Japanese Unexamined Patent Application Publication No. 04-277150, and Japanese Unexamined Patent Application Publication No. 2003-263090. This reference plate is moved in the lateral direction, whereby the paper position is adjusted. In the image forming apparatus disclosed in the Japanese Unexamined Patent Application Publication No. 64-8159, paper is moved in the lateral direction by the lateral movement of the roller which nips paper, whereby the paper position is adjusted.

However, the following problem is found in the image forming apparatus disclosed in the Japanese Unexamined Patent Application Publication No. 2002-338088, Japanese Unexamined Patent Application Publication No. 01-192649, Japanese Unexamined Patent Application Publication No. 04-277150, and Japanese Unexamined Patent Application Publication No. 2003-263090. Namely, when the reference plate is moved in the lateral direction, the plate must be returned to the standard position for each page in order to avoid interference with the succeeding paper subsequent to position adjustment. This arrangement fails to meet the requirement of high-speed paper conveyance, and if paper is conveyed in response to the movement of the reference plate, productivity will be reduced.

In the meantime, in the image forming apparatus disclosed in the Japanese Unexamined Patent Application Publication No. 64-8159, paper position is adjusted by the lateral movement of the roller. This invention meets the requirement for high-speed paper conveyance, without having to return the roller. However, there is a limit to the roller moving range. Beyond this range, paper position adjustment is accompanied by difficulties. This makes it necessary to control the roller position so that the limit of roller movement will not be reached.

One of the proposals refers to the method, wherein a movable limit detector is installed, and the page-by-page control is provided in such a way as to move the roller by the amount of paper misalignment from a predetermined position. When the movable limit has been reached, the operation is suspended and the roller is returned to the standard position. Another proposal refers to the method wherein, subsequent to correction of the misalignment of paper for each page, the roller is returned to the standard position between sheets of paper.

However, any of these methods is accompanies by the problem of reducing the productivity. Moreover, very complicated high-speed operation must be performed in order to minimize the reduction in productivity in the method of returning the roller to the standard position for each page.

To be more specific, of the image forming apparatuses of the embodiments of the present invention, the image forming apparatus of the first embodiment for forming an image on a medium according to image data includes:

a moving roller capable of axial movement in the main scanning direction for the purpose of ensuring that the aforementioned medium during conveyance is moved in the main scanning direction to perform position adjustment in preparation for the aforementioned image formation;

a medium end position detecting section for detecting the end position of the aforementioned medium in the main scanning direction; and a control section for calculating the amount of misalignment of the medium in the main scanning direction from the end position detected by the medium end position detecting section;

wherein the control section obtains the correction amount of the image forming position according to the amount of misalignment of the medium having been calculated, and provides control in such a way that the medium coming later than the aforementioned medium by a predetermined number of pages is moved by the aforementioned moving roller by the difference between the correction amount of the image forming position and the amount of misalignment of the medium coming later by a predetermined number of pages, and the image forming position is corrected according to the correction amount.

The image forming apparatus of the second embodiment for forming an image on a medium according to image data includes:

a moving roller capable of axial movement in the main scanning direction for the purpose of ensuring that the aforementioned medium during conveyance is moved in the main scanning direction to perform position adjustment in preparation for the aforementioned image formation;

a medium end position detecting section for detecting the end position of the aforementioned medium in the main scanning direction; and a control section for calculating the amount of misalignment of the medium in the main scanning direction from the end position detected by the medium end position detecting section;

wherein the control section obtains the correction amount of the image forming position according to the amount of misalignment of the medium having been calculated, and information on the moving position of the roller, and provides control in such a way that the medium coming later than the aforementioned medium by a predetermined number of pages is moved by the aforementioned moving roller by the difference between the correction amount of the image forming position and the amount of misalignment of the medium coming later by a predetermined number of pages, and the image forming position is corrected according to the correction amount.

The image forming apparatus of the third embodiment for forming an image on a medium according to image data includes:

a moving roller capable of axial movement in the main scanning direction for the purpose of ensuring that the aforementioned medium during conveyance is moved in the main scanning direction to perform position adjustment in preparation for the aforementioned image formation;

a medium end position detecting section for detecting the end position of the aforementioned medium in the main scanning direction; and a control section for calculating the amount of misalignment of the medium in the main scanning direction from the end position detected by the medium end position detecting section;

wherein the control section corrects the image forming position on the medium according to the amount of misalignment of the medium having been calculated, and moves the medium by using the aforementioned moving roller by the difference between correction amount of the image forming position and the amount of misalignment of the medium.

The image forming apparatus of the fourth embodiment for forming an image on a medium according to image data includes:

a moving roller capable of axial movement in the main scanning direction for the purpose of ensuring that the aforementioned medium during conveyance is moved in the main scanning direction to perform position adjustment in preparation for the aforementioned image formation;

a medium end position detecting section for detecting the end position of the aforementioned medium in the main scanning direction; and a control section for calculating the amount of misalignment of the medium in the main scanning direction from the end position detected by the medium end position detecting section;

wherein the control section corrects the image forming position on the medium according to the amount of misalignment of the medium having been calculated and the information on the moving position of the roller, and moves the medium by using the aforementioned moving roller by the difference between the correction amount of the image forming position and the amount of misalignment of the medium.

DETAILED DESCRIPTION OF THE PREFERRED EMBODIMENT

Figure 1:
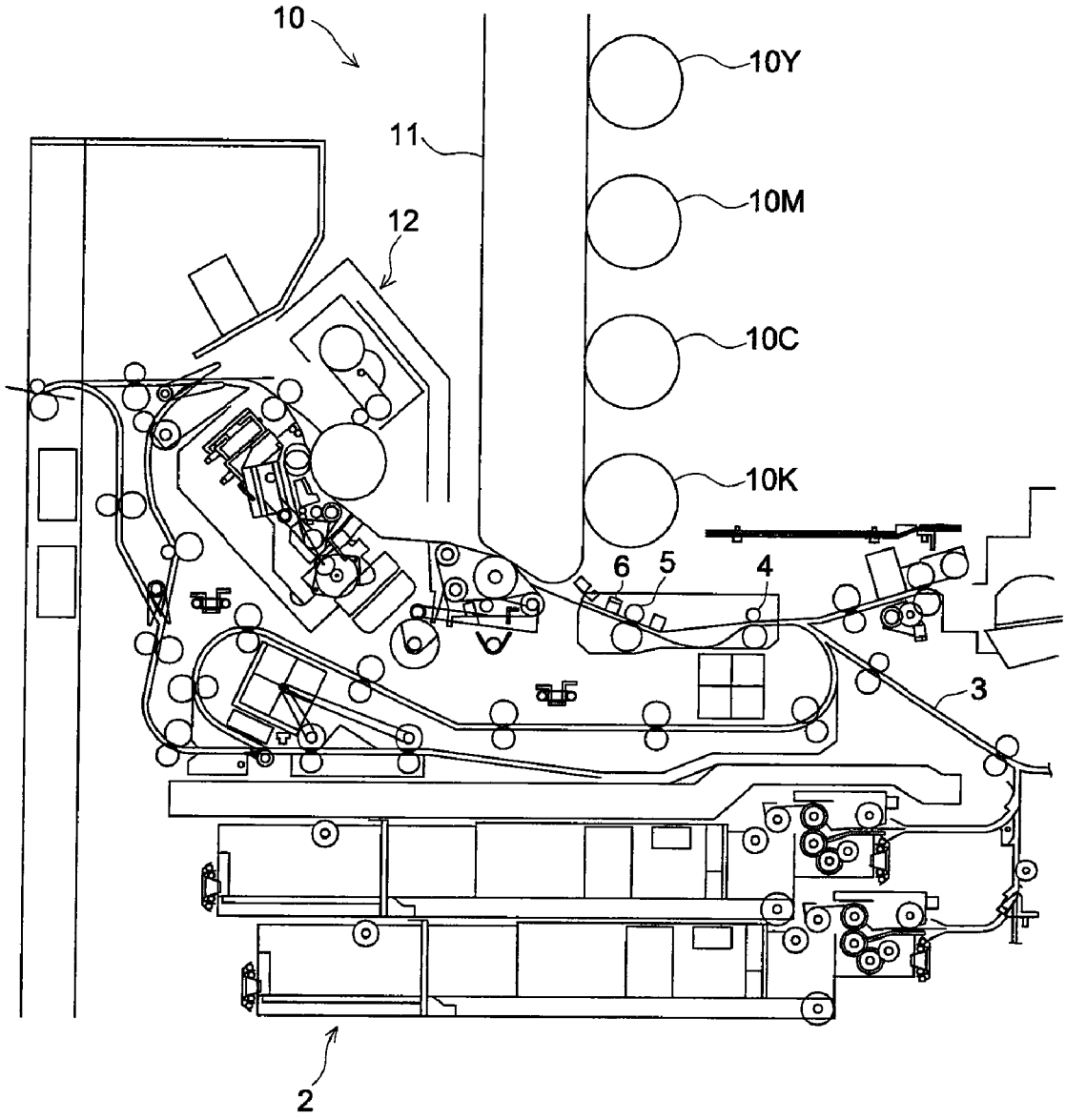
FIG. 1 is a drawing representing a part of the mechanical structure of the image forming apparatus relating to an embodiment of the present invention.

The following further describes another embodiment based on the aforementioned embodiment:

The image forming apparatus of the fifth embodiment is the same as any one of the aforementioned first through fourth embodiments, further characterized in that the aforementioned moving roller is a registration roller for correcting skew of the medium being conveyed.

The image forming apparatus of the sixth embodiment is the same as the aforementioned fifth embodiment, further characterized in that the moving roller includes a loop roller arranged upstream of the aforementioned registration roller.

The image forming apparatus of the seventh embodiment is the same as any one of the aforementioned first through sixth embodiments, further characterized in that the aforementioned medium end position detecting section is arranged in the vicinity of the moving roller.

The image forming apparatus of the eighth embodiment is the same as any one of the aforementioned first through seventh embodiments, further characterized in that the aforementioned medium end position detecting section is arranged downstream of the aforementioned moving roller.

The image forming apparatus of the ninth embodiment is the same as any one of the aforementioned first through eighth embodiments, further characterized in that the control section returns the moving roller to the standard position after completion of the job.

The image forming apparatus of the tenth embodiment is the same as any one of the aforementioned first through ninth embodiments, further characterized in that the aforementioned image forming apparatus is a tandem type color image forming apparatus.

The representative examples of effects of the invention will be described as follows.

The image forming apparatus of the present invention for forming an image on a medium according to image data includes a moving roller capable of axial movement in the main scanning direction for the purpose of ensuring that the aforementioned medium during conveyance is moved in the main scanning direction to perform position adjustment in preparation for the aforementioned image formation;

a medium end position detecting section for detecting the end position of the aforementioned medium in the main scanning direction; and a control section for calculating the amount of misalignment of the medium in the main scanning direction from the end position detected by the medium end position detecting section;

wherein the control section obtains the correction amount of the image forming position on the aforementioned medium according to the amount of misalignment of the medium having been calculated, or the amount of misalignment of the medium and the information on moving position of the roller, and provides control in such a way that the aforementioned medium or the medium coming later than the aforementioned medium by a predetermined number of pages is moved by the aforementioned moving roller by the difference between the correction amount of the image forming position and the amount of misalignment of the target medium, and the image forming position is corrected according to the correction amount. This arrangement ensures high-quality positioning of a medium and image while keeping the productivity unaffected. The moving range limit of the movable roller can be reduced under the control based on the detected medium end position alone. By making a concurrent use of the information on the moving position of the roller (Integrated value of the amounts of previous movements), force is applied to converge the deviation of the integrated value on "0". This makes it possible to provide control in such a way that the integrated value for the moving amount of the roller (roller position) will become close to the standard position.

When correcting the image forming position using the aforementioned amount of medium misalignment and the moving position of the roller, the corrected position can be obtained from the following formula (1).

$$\text{Image forming position correction amount} = \text{medium misalignment} \times Kp - \text{roller position} \times Ki \quad (1)$$

Since the aforementioned image forming position correction amount can be fed back to the detected medium misalignment value on a closed-loop basis, the numeral around "1" is appropriate as the coefficient Kp of the proportional part in the aforementioned formula (1), and "1" is preferably used.

The greater the integrated part Ki, the greater the tendency toward the average deviation of the correction amount reaching "0". On the whole, there is an increase in the range of fluctuation of the correction amount. The range of fluctuation is the minimum when coefficient Ki=0, and a deviation will occur. If the value is "1" or more, divergence will occur. Thus, coefficient Ki is set within the range of $0 \leqq Ki < 7$. With consideration given to these points, Ki is adequately determined according to the conditions of use within the aforementioned range of values.

In the case where the medium is located on the upstream side of the moving roller and an image is not yet formed on the image carrier when the correction amount has been obtained by detecting the end position in the main scanning direction, the image forming position can be corrected and the movement by the moving roller can be achieved, for the aforementioned medium for which the correction amount for the image forming position has been obtained by detecting the end position in the main scanning direction. However, in the case where image formation on the medium whose end position has been detected has already been started on the image carrier when the aforementioned correction amount is obtained, the image forming position cannot be corrected. Thus, the aforementioned correction of the image forming position and movement by the moving roller are performed for another medium after the medium by a predetermined number of pages. It should be noted, however, that the present invention is not restricted to the number of pages by which the target medium comes after the medium. Correction of the image forming position and movement by the moving roller are preferably performed at the earliest possible conveniences. Among the media for which image formation has not yet started, it is preferred to select a page of medium closest to that of medium for which the correction amount of the image forming position has been obtained. Calculation of the correction amount, correction of the image forming position and movement of medium by the moving roller are performed for each page

Embodiment 1

The following describes the image forming apparatus as an embodiment of the present invention with reference to FIG. 1 through FIG. 5. FIG. 1 shows a part of the mechanical components of the tandem image forming apparatus.

Figure 2:
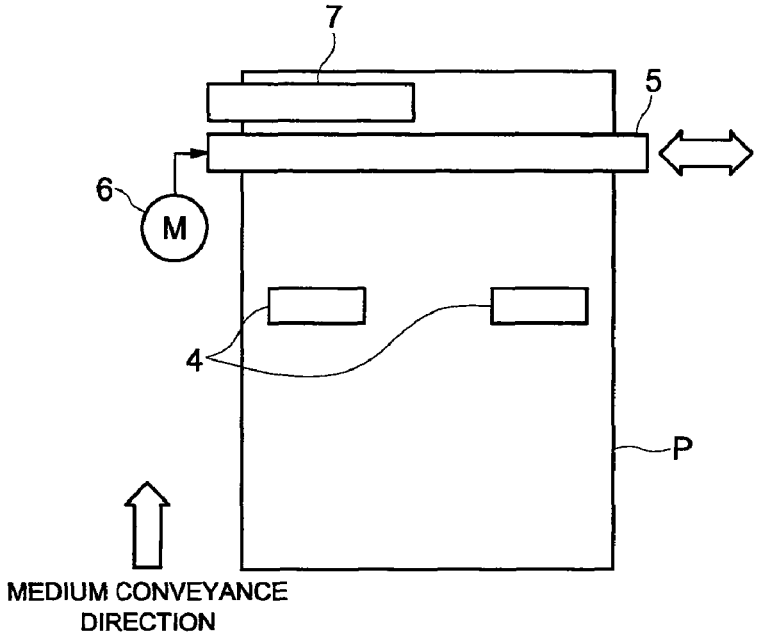
FIG. 2 is a schematic view representing the positional relationship among the registration roller, uneven-distribution sensor and medium relating to an embodiment of the present invention.

The image forming apparatus 1 includes a sheet feed tray 2 for storing the medium P, and a conveyance path 3 for conveying the medium fed from the sheet feed tray 2. As shown in FIGS. 1 and 2, a loop roller 4 is installed on the conveyance path 3. Immediately downstream thereof, a registration roller 5 serving as a moving roller of the present invention is installed. The loop roller 4 and registration roller 5 are driven by a drive section (not illustrated) to feed the medium P. Further, the registration roller 5 can be shifted by a predetermined distance in the main scanning direction by a swaying motor 6.

Immediately downstream of the registration roller 5, uneven-distribution detection sensors 7 are arranged in the main scanning direction to detect the end position in the main scanning direction of the conveyed medium P. The uneven-distribution detection sensor 7 corresponds to the medium end position detecting section of the present invention. The uneven-distribution sensor 7 can be made up of a light emitting element composed of a light emitting diode array, and a light receiving element composed of a line CCD arranged with the conveyance path 3 sandwiched in-between. The uneven-distribution sensor 7 detects the end of the medium P passing through them. The end position can be calculated from the time of light received by the light receiving element at the time of end detection, and the standard position at the center of the conveyance path 3. Since the medium P is normally conveyed according to this center standard, the end standard position is assumed for each size, and the difference in the distance between the end position of the detected medium and the end standard position is calculated as the amount of misalignment of the medium.

An image forming section 10 capable of forming images in yellow, magenta, cyan and black colors is installed on the downstream side of the uneven-distribution detection sensor 7. This image forming section includes a writing section 10A capable of writing for each color, photoreceptors 10Y, 10M, 10C and 10K as image carriers, an endless belt-shaped intermediate transfer body 11, and a fixing device 12. A charging device, exposure device as the writing section, developing device and cleaning section (not illustrated) for each color are installed around each of the photoreceptors 10Y, 10M, 10C and 10K.

In the image forming section 10, a latent image is formed by the writing section according to the image data on a predetermined writing position (image forming position) of the photoreceptors 10Y, 10M, 10C and 10K charged by the charging section. The latent image is developed by the developing device and is transferred onto the intermediate transfer body 11. This toner image is transferred onto the medium P conveyed along the conveyance path 3 and is fixed by the fixing device 12, whereby the processing of image formation terminates. The image-formed medium P is ejected to an ejection tray or the like.

Figure 3:
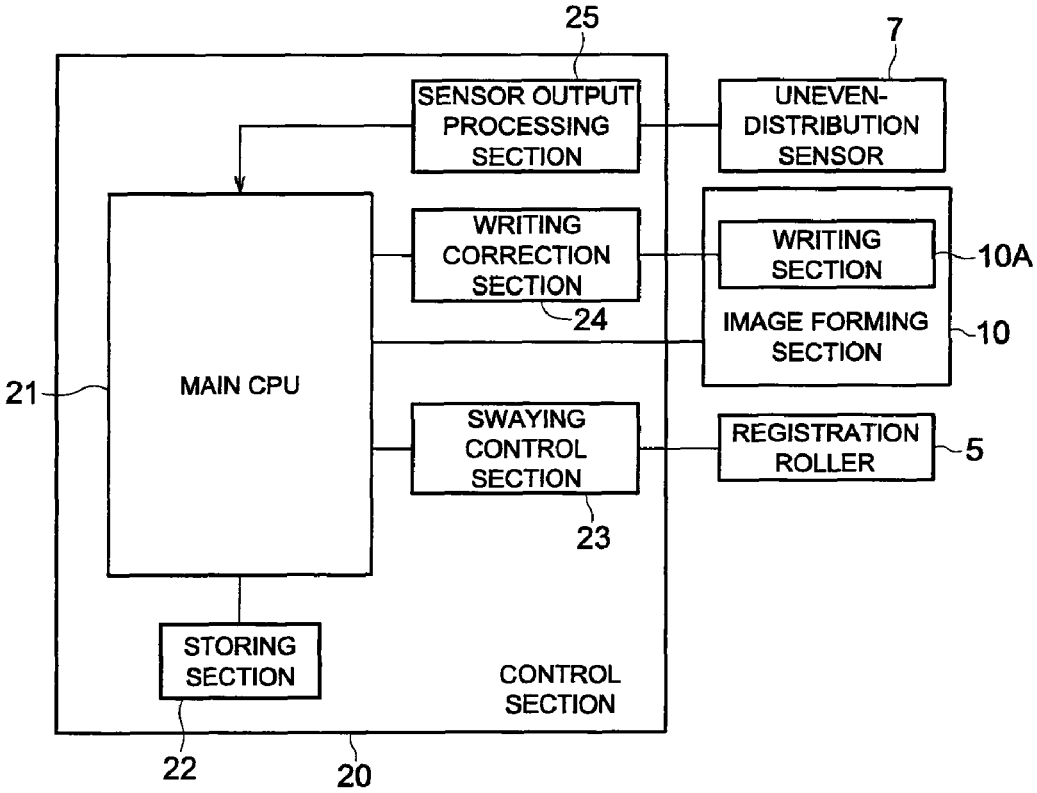
FIG. 3 is a block diagram showing how to control the image forming apparatus relating to an embodiment of the present invention.

FIG. 3 is a block diagram representing partial control of the image forming apparatus 1.

The control section 20 provides overall control of the image forming apparatus, and is provided with the main CPU 21 to perform various forms of computation. The main CPU 21 is connected with the storage section 22 for temporary storage of the data on the standard end position of the media of different sizes and other data. The main CPU 21 permits data to be read and written whenever required. The storage section 22 is made up of a flash memory, RAM and others.

Further, in the control section 20, the main CPU 21 is connected with a swaying control section 23, which is connected with a registration roller 5 to receive swaying control. The swaying control section 23 can be composed of a CPU and the program for running the CPU.

The main CPU 21 controls axial movement (swaying) of the registration roller 5, and integrates the moving amount of the roller. The integrated value is temporarily stored as information on roller moving position in the aforementioned storage section 22. This information is recalled when the image forming position is corrected.

In the control section 20, the main CPU 21 is connected with the image forming section 10, whereby image formation is controlled. At the same time, the writing section 10A constituting part of the image forming section 10 can be controlled by the main CPU 21 through the writing correction section 24. In response to the correction of the image forming position by the main CPU 21, the writing correction section 24 sets the writing startup timing for the writing section 10A. The setting of the writing timing allows the image forming position to be adjusted in the main scanning direction. The writing correction section 24 can be composed of a CPU and a program for running the same, for example.

Further, the control section 20 is connected with the uneven-distribution sensor 7 through the sensor output processing section 25. The output from the uneven-distribution sensor 7 is sent to the sensor output processing section 25, and is subjected to waveform processing. After that, the end position data is outputted to the main CPU 21. The main CPU 21 reads, from the storage section 22, the standard end position of the recording medium P being conveyed, and calculates the amount of medium misalignment from the distance between the standard end position and the aforementioned end position data having been detected. The amount of medium misalignment is temporarily stored in the storage section 22, and is recalled when the image position misalignment of the succeeding medium P is corrected. The sensor output processing section 25 can be composed of a CPU and a program for running the same, for example.

Figure 4:
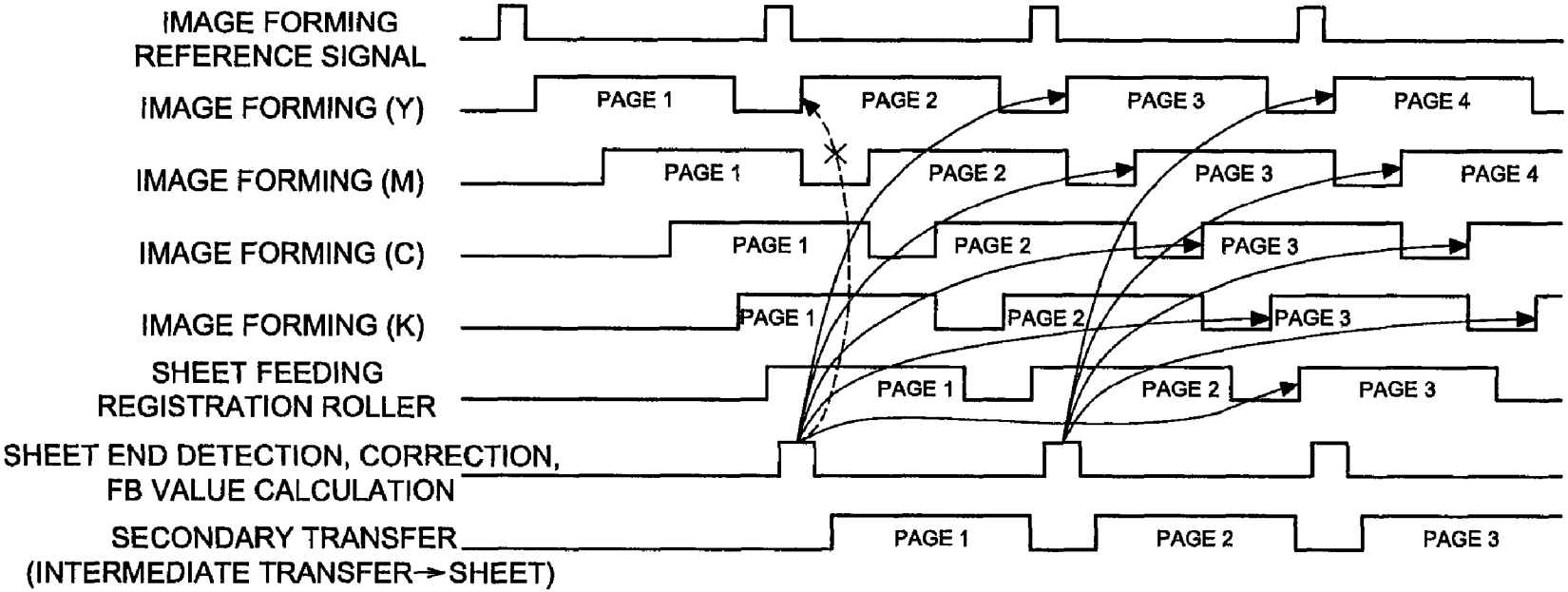
FIG. 4 is a timing chart showing the process of image formation relating to an embodiment of the present invention.
Figure 5:
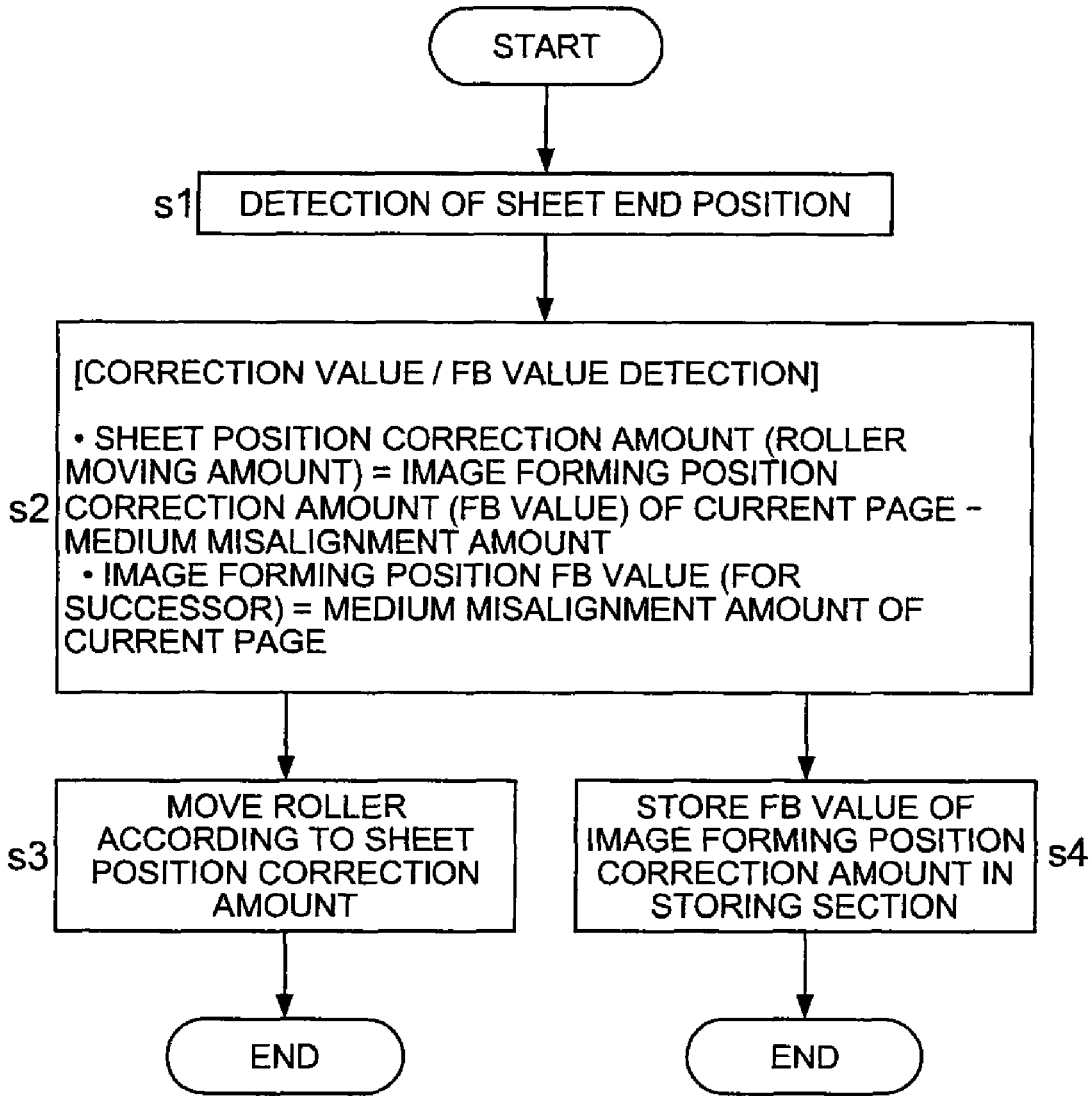
FIG. 5 is a flow chart showing the procedure of position adjustment between the medium and image relating to an embodiment of the present invention.

Referring to FIGS. 4 and 5, the following describes the procedures of adjusting the positions of the medium and image in the image forming apparatus. FIG. 4 is a timing chart showing the process of image formation. FIG. 5 is a flow chart showing the procedure of the aforementioned position adjustment. In this embodiment, the correction amount is fed back to the medium two pages after the medium for which the paper end position is detected and for which the correction amount of the image forming position has been obtained.

In response to the image data as a group, the job is started to perform a series of image formation. Then the media P are conveyed one after another from the sheet feed tray 2 through the conveyance path 3. During the process of conveyance, the control section 20 outputs an image formation reference signal, as shown in FIG. 4, whereby image formation in the image forming section 10 is started. In this image formation process, images of different colors are written in the order of photoreceptors 10Y, 10M, 10C and 10K by the writing section 10A according to a predetermined writing position. When a feedback value is given for this writing position, the feedback value is read from, the storage section 22, and the writing timing is set by the writing correction section 23, based on the image forming position correction amount of the feedback value, whereby the position of writing by the writing section 10A is corrected.

During the process of image formation, the medium P passes through the loop roller 4, and hits the registration roller 5 in the state of suspension. The medium P is further fed by the loop roller 4, whereby the skew of the medium P is corrected by means of bend of the medium P. After that, the registration roller 5 is rotated to send the medium P downstream. The paper end position of this medium Is detected by the uneven-distribution sensor 7 located immediately downstream of the registration roller 5. In this case, the detection output is subjected to waveform processing by the sensor output processing section 25 and the detection output time is obtained. Thus, the end position of the medium P is obtained (Step s1), and the position data is sent to the main CPU 21.

The main CPU 21 calculates the amount of medium misalignment from the standard end position of the medium, which has been read from the storage section 22, and the aforementioned medium end position having been detected The main CPU 21 calculates the paper position correction amount, i.e., the moving amount of the roller from the difference between the image forming position correction amount and the amount of medium misalignment (Step s2). The image forming position correction amount is supplied, as a feedback value, from the amount of medium misalignment detected on the medium two pages before. This feedback value is stored in the storage section 22, and is recalled at the time of position adjustment of the target medium P. Accordingly, on the first and second pages immediately after job startup, the aforementioned processing is carried out, with the image forming position correction amount assumed as "0".

According to the moving amount of the roller having been obtained from the aforementioned processing, the swaying motor 6 is controlled by the swaying control section 23, and the registration roller 5 is moved in the axial direction (Step s3). The medium is fed the same distance as that of the moving amount of the roller in the main scanning direction by this roller movement and is fed to the image forming section 10. Further, the image forming position correction amount calculated by the aforementioned procedure is stored in the storage section 22 as the feedback value for medium two pages after (Step s4). In this embodiment, only the registration roller 5 is movable in the axial direction. However, the loop roller 4 can be moved in the axial direction by being synchronized with the registration roller 5. In the image forming section, the image forming position has been corrected according to the feedback value, as described above, and the image has been written onto the intermediate transfer body 11. As shown in FIG. 4, an image is transferred from the intermediate transfer body 11 onto the medium whose position in the main scanning direction has been adjusted. The aforementioned procedure is repeated for every page until the job has been completed. After termination of the job, it is preferred that the registration roller 5 should be reset to the standard position in preparation for the next job.

Figure 6:
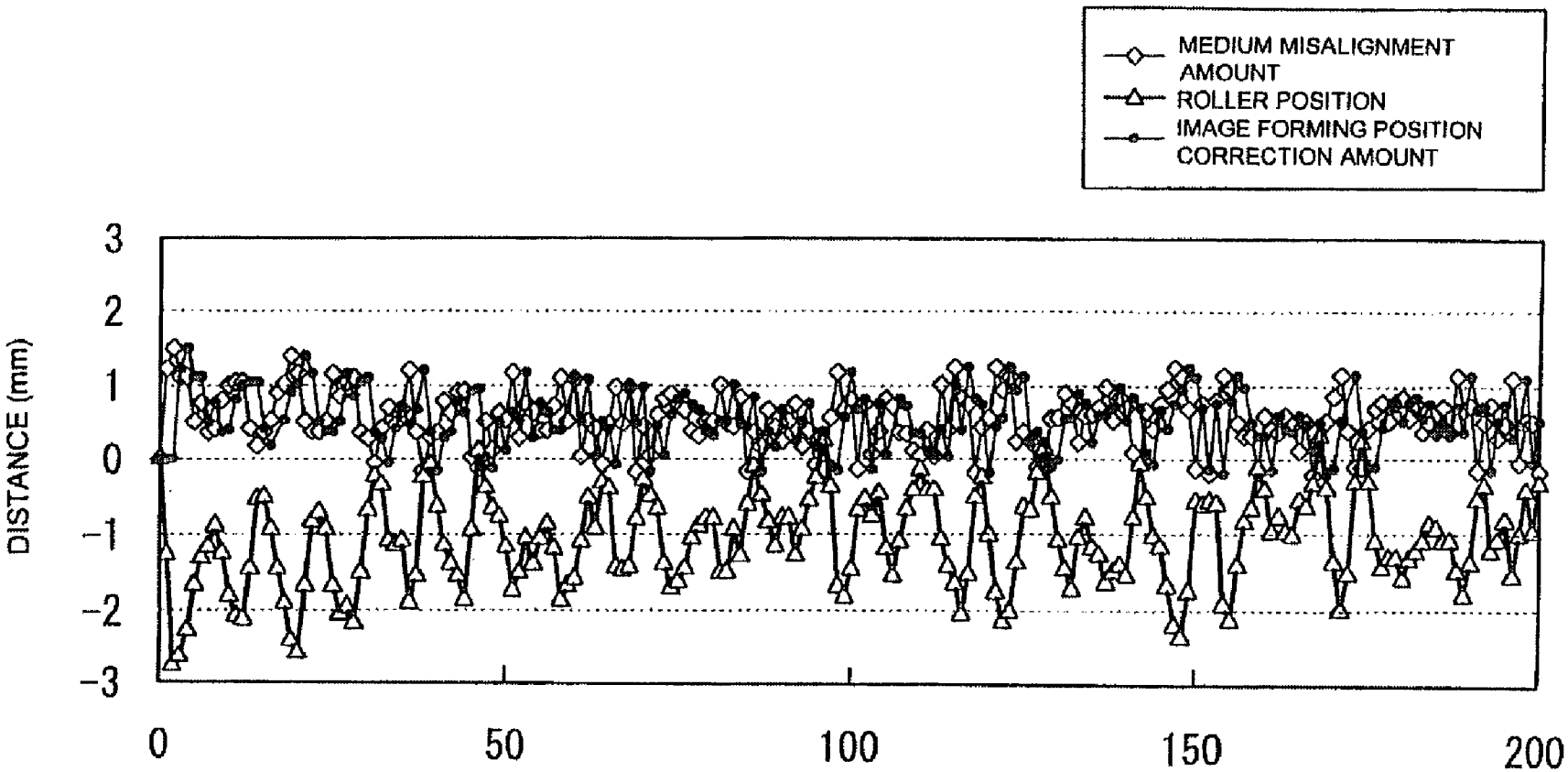
FIG. 6 is a diagram showing changes in the roller position and image forming position correction amount in an example of position adjustment between the medium and image relating to an embodiment of the present invention.

The following Table 1 and FIG. 6 show an example wherein the job has been executed while the position adjustment of the medium and image is conducted by using the aforementioned procedure. The amount of medium misalignment having been detected by the uneven-distribution sensor 7 is expressed as the distance from the standard position with plus-minus sign wherein the standard position is assumed as "0". Further, the moving amount of the roller is equal to the image forming position correction amount—(minus) the amount of medium misalignment. The registration roller is moved the difference between the positions of the image and medium to adjust the image and medium positions. Since only the amount of medium misalignment is utilized for the feedback position, the feedback position remains unchanged from the amount of medium misalignment of the medium two pages before.

As a result of this procedure, at the time of image formation, the registration roller position continues to move in the range of about ±mm around the vicinity of −1 mm from the standard position.

TABLE 1

| Page No. | Medium misalignment | Moving amount of the roller | Roller position | Correction of image forming position | | Feedback value |
|---|---|---|---|---|---|---|
| 1 | 1.23 | -1.23 | -1.23 | 0 | | 1.23 |
| 2 | 1.50 | -1.50 | -2.73 | 0 | | 1.50 |
| 3 | 1.13 | 0.10 | -2.63 | 1.23 | | 1.13 |
| 4 | 1.11 | 0.39 | -2.24 | 1.50 | | 1.11 |
| 5 | 0.52 | 0.61 | -1.63 | 1.13 | | 0.52 |
| 6 | 0.75 | 0.36 | -1.27 | 1.11 | | 0.75 |
| • | • | • | • | • | | • |
| • | • | • | • | • | | • |

Unit (mm)

Embodiment 2

Figure 7:
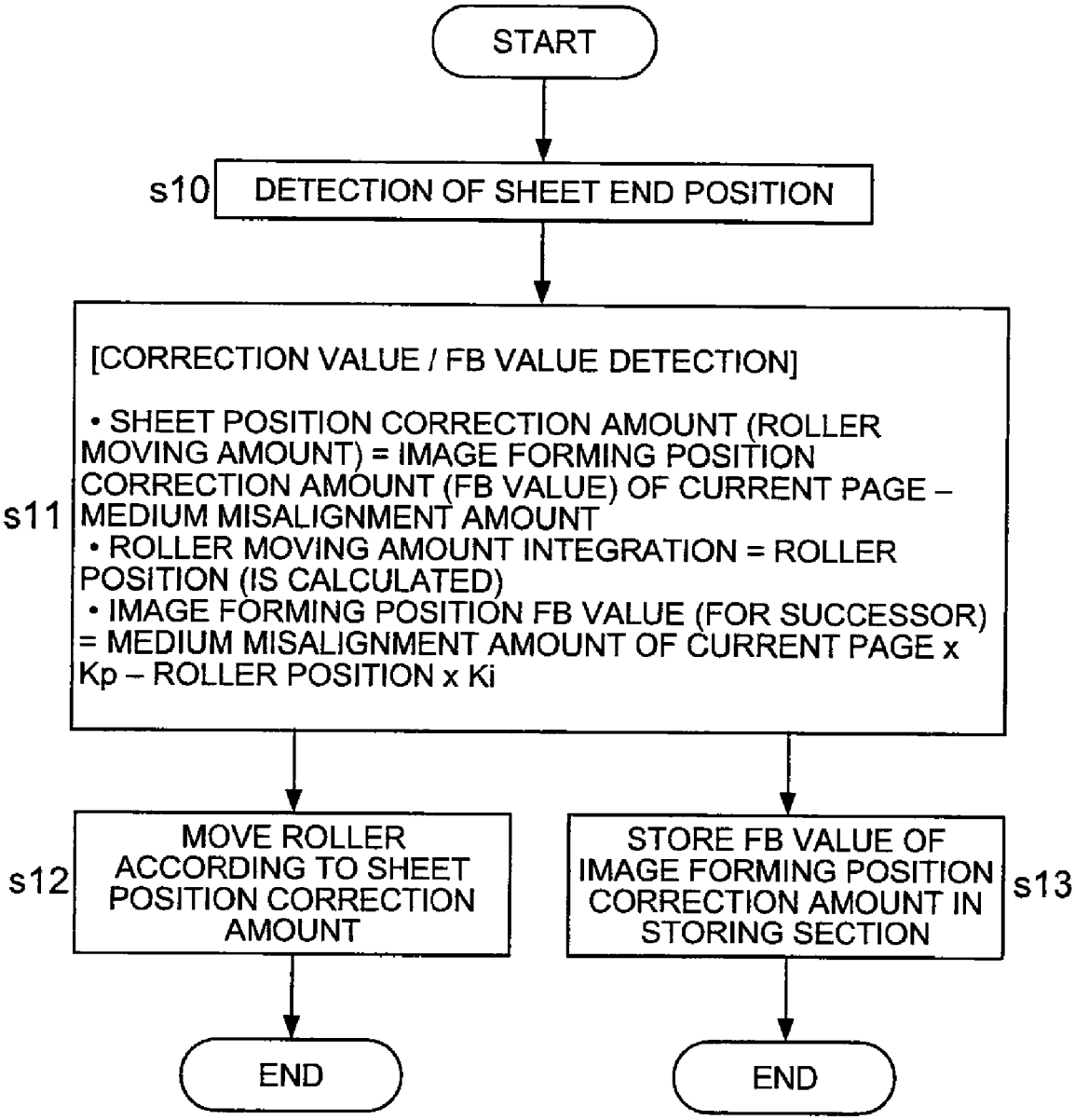
FIG. 7 is a flow chart showing the procedure of position adjustment between the medium and image in another embodiment of the present invention.

In the aforementioned embodiment, when the correction amount of the image forming position is calculated, only the amount of medium misalignment is used. In the present invention, the correction amount of the image forming position can also be calculated based on the amount of medium misalignment and the information on the moving position of the roller. This method will be described with reference to the flow chart of FIG. 7. The mechanical structure of the image forming apparatus, block diagram and timing chart are the same as those in the aforementioned embodiment, and will not be described to avoid duplication.

In this embodiment, when the paper end position has been detected by the aforementioned uneven-distribution sensor 7, the amount of medium misalignment is calculated in the same manner as above. Further, the main CPU 21 calculates the paper position correction amount, i.e., the moving amount of the roller from the difference between the image forming position correction amount and the amount of medium misalignment. The image forming position correction amount is supplied as a feedback value from the amount of medium misalignment detected on the medium two pages before and the information on the moving position of the roller of two pages before. This feedback value is stored in the storage section 22, and is recalled at the time of position adjustment of the target medium P. Thus, in this embodiment as well, on the first and second pages at the time of job startup, the aforementioned processing is carried out with the image forming position correction amount assumed as "0".

The aforementioned image forming position correction amount (feedback value) is determined by the amount of medium misalignment on the current page and the roller position. In this case, calculation is made using the aforementioned formula (1) The coefficient Kp is set at about 1, preferably at just 1, and the coefficient Ki is set within the range of $0 \leqq Ki < 1$.

The swaying motor 6 is controlled by the swaying control section 23 according to the moving amount of the roller having been obtained by the aforementioned processing, and the registration roller 5 is moved in the axial direction (Step s12). Further, the image forming position correction amount having been calculated is stored in the storage section 22 as the feedback value for the medium two pages after (Step s13). In the image forming section 10, the image forming position is corrected according to the feedback value called from the storage section 22 at the time of image formation, and the image is written. The image is transferred onto the medium whose position in the main scanning direction has been adjusted. The aforementioned procedure is repeated for each page until the job terminates.

Figure 8:
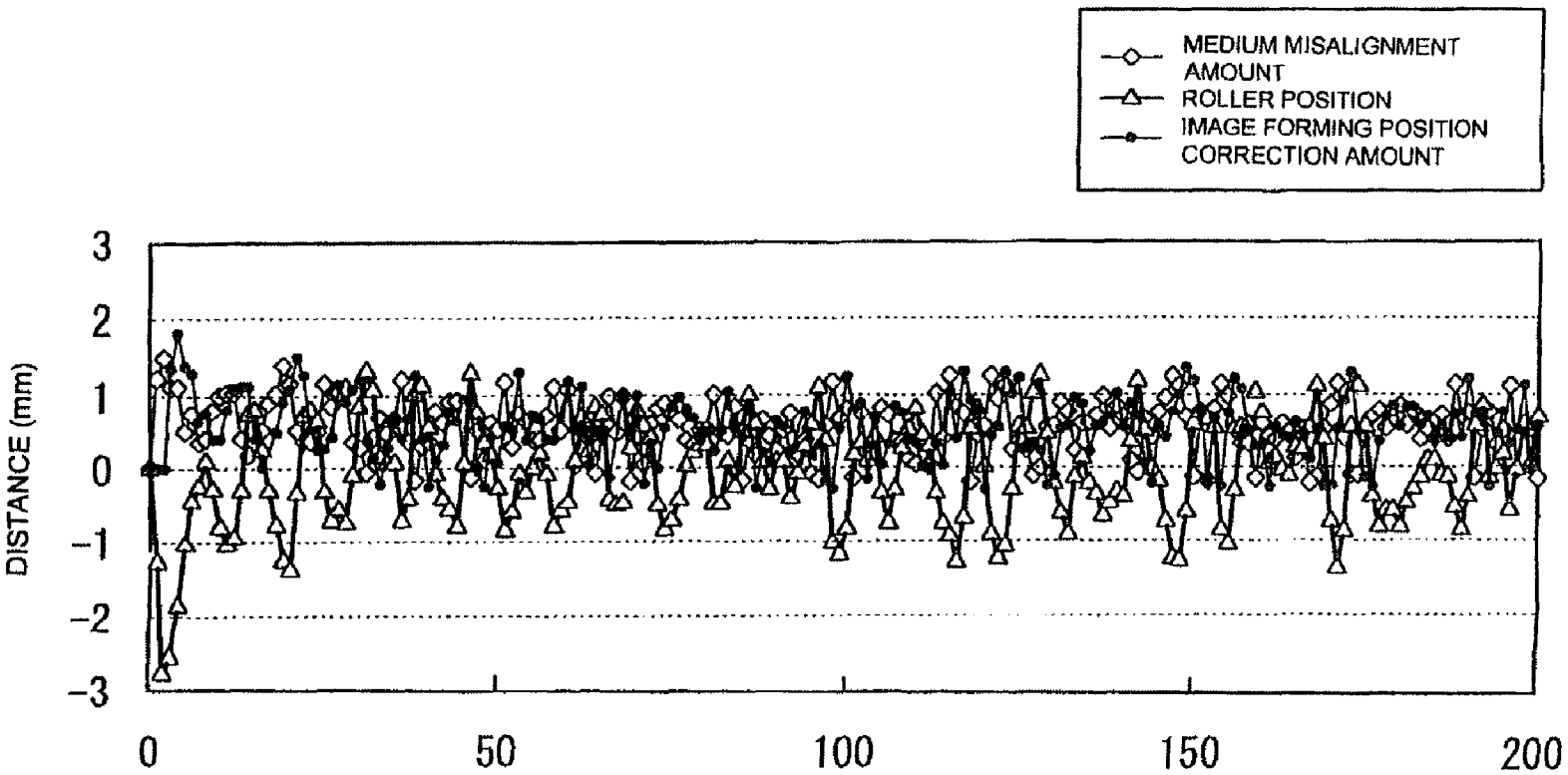
FIG. 8 is a diagram showing changes in the roller position and image forming position correction amount in an example of position adjustment between the medium and image in another embodiment of the present invention.

The following Table 2 and FIG. 8 show an example wherein position adjustment between the medium and image is performed according to the aforementioned procedure. The amount of medium misalignment detected by the uneven-distribution sensor 7 is expressed as the distance from the standard position with plus-minus sign wherein the standard position is assumed as "0". Further, the moving amount of the roller is the image forming position correction amount—(minus) the amount of medium misalignment. The roller is moved the difference between the positions of the image and medium, whereby position adjustment between the image and medium is performed. The feedback value is obtained according to the aforementioned formula (1), using the amount of medium misalignment and the information on the moving position of the roller. In this example, coefficient Kp=1, coefficient Ki=0.1. The aforementioned preferable number 1 is used as the coefficient Kp. For Ki, 0.1 is used as the numeral capable of ensuring that the integrated value of registration roller positions is converged on the vicinity of "0" after about ten pages of media according to simulation. This numeral is determined by attaching greater importance to minimization of changes, at the sacrifice of convergence speed. Thus, if high-speed convergence is required despite an increase in the range of fluctuation, value Ki is increased. For example, when Ki is set at 0.3, the fluctuation can be converged by about six pages of media. However, the range of fluctuation will be about 1.5 times the level when Ki is set at 0.1.

As a result of this procedure, at the time of image formation, the registration roller position continues to move in the range of about ±1 mm around the vicinity of the standard position.

TABLE 2

| Page No. | Medium misalignment | Moving amount of the roller | Roller position | Correction of image forming position | | Feedback value |
|---|---|---|---|---|---|---|
| 1 | 1.23 | -1.23 | -1.23 | 0 | | 1.353 |
| 2 | 1.50 | -1.50 | -2.73 | 0 | | 1.773 |
| 3 | 1.13 | 0.223 | -2.507 | 1.353 | | 1.381 |
| 4 | 1.11 | 0.663 | -1.844 | 1.773 | | 1.294 |
| • | • | • | • | • | | • |
| • | • | • | • | • | | • |

Unit (mm)

Embodiment 3

The aforementioned embodiments assume that the correction amount of the image forming position obtained by the amount of medium misalignment is applied to another medium after the medium by a predetermined number of pages. In the present invention, however, the correction amount of the image forming position obtained by the amount of medium misalignment can be applied to the medium itself, whereby the image forming position is corrected. Such an example can be preferably applied to a black-and-white image forming apparatus. It should be noted, however, that the present invention is not restricted to the case wherein such an embodiment is applied to the black-and-white image forming apparatus alone.

To be more specific, in this example, when the image forming position correction amount is obtained from the amount of medium misalignment, the value obtained by 0.9 times the amount of medium misalignment is determined as the image forming position correction amount, and the moving amount of the registration roller is calculated from the difference between the aforementioned amount of medium misalignment and the correction amount, as shown in Table 3. This medium is moved the aforementioned moving amount of the roller, and the image forming position is corrected based on the aforementioned correction amount, whereby an image is formed on this medium.

As shown in this example, the position adjustment between the medium and image can be achieved by the position adjustment of medium in the main scanning direction and the correction of the image forming position. The moving amount of the registration roller can be reduced, as compared to the case wherein the position is adjusted only by the movement of the registration roller.

TABLE 3

| Page No. | Medium misalignment | Moving amount of the roller | Roller position | Correction of image forming position |
|---|---|---|---|---|
| 1 | 1.23 | −0.12 | −0.12 | 1.11 |
| 2 | 1.50 | −0.15 | −0.27 | 1.35 |
| 3 | 1.13 | −0.11 | −0.38 | 1.02 |
| 4 | 1.11 | −0.11 | −0.49 | 1.00 |

TABLE 3-continued

| Page No. | Medium misalignment | Moving amount of the roller | Roller position | Correction of image forming position |
|---|---|---|---|---|
| 5 | 0.52 | −0.05 | −0.55 | 0.47 |
| 6 | 0.75 | −0.08 | −0.62 | 0.68 |
| . | . | . | . | . |
| . | . | . | . | . |
| . | . | . | . | . |

Unit (mm)

Embodiment 4

In the present invention, the correction amount of the image forming position obtained from the amount of medium misalignment and the information on the moving position of the roller can be applied to the medium itself, whereby the image forming position is corrected. Such an example can also be preferably applied to the black-and-white image forming apparatus.

To be more specific, in this example, the image forming position correction amount is calculated from the amount of medium misalignment and the information on the moving position of the roller according to the aforementioned formula (1), as shown in Table 4. In this case, coefficient Kp is set at 1 and coefficient Ki is set at 0.1, similarly to the case of the aforementioned embodiments. Further, the moving amount of the roller is calculated from the difference between the aforementioned amount of medium misalignment and the correction amount. This medium is moved the aforementioned moving amount of the roller and the image forming position is corrected based on the aforementioned correction amount, whereby an image is formed on this medium. In this example, the position between the medium and image can be adjusted by the position adjustment of the medium in the main scanning direction and correction of the image forming position, whereby the roller position can be converged to the standard position.

TABLE 4

| Page No. | Medium misalignment | Moving amount of the roller | Roller position before moving | Roller position after moving | Correction of image forming position |
|---|---|---|---|---|---|
| 1 | 1.23 | −0.10 | 1.00 | 0.90 | 1.13 |
| 2 | 1.50 | −0.09 | 0.90 | 0.81 | 1.41 |
| 3 | 1.13 | −0.08 | 0.81 | 0.73 | 1.05 |
| 4 | 1.11 | −0.07 | 0.73 | 0.66 | 1.04 |
| 5 | 0.52 | −0.07 | 0.66 | 0.59 | 0.45 |
| 6 | 0.75 | −0.06 | 0.59 | 0.53 | 0.69 |
| . | . | . | . | . | . |
| . | . | . | . | . | . |
| . | . | . | . | . | . |

Unit (mm)

The aforementioned moving roller contained in the present invention can be provided to ensure movement of the medium in the main scanning direction. The registration roller for correcting the skew of the medium conveyed is preferably used as the moving roller. The moving roller can include a loop roller that bends the medium suspended by the registration roller and promotes straightening the medium. The medium is moved by two or more moving rollers located at different positions in the direction of conveyance, whereby high-precision movement of the medium without a skew in the main scanning direction is ensured.

An uneven-distribution sensor of conventional use can be employed as the medium end position detecting section for detecting the end position of the medium in the main scanning direction. For example, a transmission type or reflection type photosensor can be utilized. This photosensor is the array type device arranged in the main scanning direction, for example. The end position of the medium can be detected by scanning in the main scanning direction. It is only required that the medium end position detecting section should be capable of detecting the end position of the medium in the main scanning direction, without the present invention being restricted to the aforementioned structure.

There is no particular restriction to the installation position of the aforementioned medium end position detecting section in the present invention. However, the medium end position detecting section is preferably installed in the vicinity of the aforementioned moving roller. It is preferably installed downstream of the aforementioned moving roller so that it is located as close as possible to the image forming section.

The control section can be mainly composed of a CPU and a program for running the same. The control section can also incorporate a ROM for storing programs and a RAM for temporary storage of the data including the correction amount for the image forming position obtained from the amount of medium misalignment or this amount of misalignment and the moving position of the roller, and information on the moving position of the roller.

The present invention is preferably applied to the tandem type color image forming apparatus that requires relatively a longer time for image formation. Without being restricted thereto, the present invention can be applied to a black-and-white image forming apparatus in the similar manner. In addition to the aforementioned advantages, the present invention provides the advantage that the medium end detection position can be determined at a furthest possible downstream position, whereby image forming position is adjusted. This added advantage can be found not only in the tandem type color image forming apparatus, but also in the black-and-white image forming apparatus.

What is claimed is:

1. An image forming apparatus which forms images on a plurality of mediums continuously for each of a plurality of jobs according to image data, the image forming apparatus comprising:

an image forming section which performs image forming on the mediums and which is capable of correcting a position of the image forming on the mediums in a main scanning direction;

a moving roller which is axially movable in the main scanning direction so as to move a medium in the main scanning direction during conveyance to conduct position adjustment thereof in preparation for image formation;

a medium end position detecting section for detecting an end position of the medium in the main scanning direction before the moving roller conducts the position adjustment; and a control section which repeats, for each of the plurality of mediums on which images are formed continuously for each of the plurality of jobs, operations including: (i) calculating an amount of misalignment of the medium in the main scanning direction based on the end position detected by the medium end position detecting section, (ii) when one of the plurality of mediums is designated as a first medium and a succeeding medium which is in a same job and which comes later by a predetermined number of pages is designated as a second medium, obtaining a correction amount of an image forming position for the second medium according to the amount of misalignment calculated for the first medium, controlling the moving roller to move the second medium by a distance corresponding to a difference between the correction amount of the image forming position and the amount of misalignment calculated for the second medium, and (iv) correcting the image forming position according to the correction amount.

2. An image forming apparatus which forms images on a plurality of mediums continuously for each of a plurality of jobs according to image data, the image forming apparatus comprising:

an image forming section which performs image forming on the mediums and which is capable of correcting a position of the image forming on the mediums in a main scanning direction;

a moving roller which is axially movable in the main scanning direction so as to move a medium in the main scanning direction during conveyance to conduct position adjustment thereof in preparation for image formation;

a medium end position detecting section for detecting an end position of the medium in the main scanning direction before the moving roller conducts the position adjustment; and a control section which repeats, for each of the plurality of mediums on which images are formed continuously for each of the plurality of jobs, operations including: (i) calculating a position of the moving roller in the main scanning direction as information on a moving position and calculating an amount of misalignment of the medium in the main scanning direction based on the end position detected by the medium end position detecting section, (ii) when one of the plurality of mediums is designated as a first medium and a succeeding medium which is in a same job and which comes later by a predetermined number of pages is designated as a second medium, obtaining a correction amount of an image forming position of the second medium according to the amount of misalignment calculated for the first medium and the information on the moving position after position adjustment of the first medium, (iii) controlling the moving roller to move the second medium by a distance corresponding to a difference between the correction amount of the image forming position and the amount of misalignment calculated for the second medium, and (iv) correcting the image forming position according to the correction amount.

3. An image forming apparatus which forms an image on a medium according to image data, the image forming apparatus comprising:

an image forming section which performs image forming on the mediums and which is capable of correcting a position of the image forming on the mediums in a main scanning direction;

a moving roller which is axially movable in the main scanning direction so as to move the medium in the main scanning direction during conveyance to conduct position adjustment thereof in preparation for image formation;

a medium end position detecting section for detecting an end position of the medium in the main scanning direction before the moving roller conducts the position adjustment; and a control section for calculating the position of the moving roller in the main scanning direction as information on a moving position and calculating an amount of misalignment of the medium in the main scanning direction based on the end position detected by the medium end position detecting section, for correcting an image forming position on the medium according to a correction amount based on the calculated amount of misalignment of the medium and the information on the moving position before the position adjustment, and for controlling the moving roller to move the medium by a distance corresponding to a difference between the correction amount of the image forming position and the amount of misalignment of the medium, the correction amount being calculated by using the following formula in which $0 \leqq Ki < 1$:

Image forming position correction amount=medium misalignment amount−misalignment amount of the roller from a standard position before the position adjustment×Ki.

4. The image forming apparatus of claim 1, wherein the moving roller comprises a registration roller which corrects a skew of the medium conveyed thereto.

5. The image forming apparatus of claim 4, wherein the moving roller includes a loop roller arranged on an upstream side of the registration roller.

6. The image forming apparatus of claim 1, wherein the medium end position detecting section is arranged near the moving roller.

7. The image forming apparatus of claim 1, wherein the medium end position detecting section is arranged on a downstream side of the moving roller.

8. The image forming apparatus of claim 1, wherein the control section returns the moving roller to a standard position after completion of a job.

9. The image forming apparatus of claim 1, wherein the image forming apparatus comprises a tandem type color image forming apparatus.

10. The image forming apparatus of claim 2, wherein the moving roller comprises a registration roller which corrects a skew of the medium conveyed thereto.

11. The image forming apparatus of claim 10, wherein the moving roller includes a loop roller arranged on an upstream side of the registration roller.

12. The image forming apparatus of claim 2, wherein the medium end position detecting section is arranged near the moving roller.

13. The image forming apparatus of claim 2, wherein the medium end position detecting section is arranged on a downstream side of the moving roller.

14. The image forming apparatus of claim 2, wherein the control section returns the moving roller to a standard position after completion of a job.

15. The image forming apparatus of claim 2, wherein the image forming apparatus comprises a tandem type color image forming apparatus.

16. The image forming apparatus of claim 3, wherein the moving roller comprises a registration roller which corrects a skew of the medium conveyed thereto.

17. The image forming apparatus of claim 16, wherein the moving roller includes a loop roller arranged on an upstream side of the registration roller.

18. The image forming apparatus of claim 3, wherein the medium end position detecting section is arranged near the moving roller.

19. The image forming apparatus of claim 3, wherein the medium end position detecting section is arranged on a downstream side of the moving roller.

20. The image forming apparatus of claim 3, wherein the control section returns the moving roller to the standard position after completion of a job.

21. The image forming apparatus of claim 3, wherein the image forming apparatus comprises a tandem type color image forming apparatus.

22. The image forming apparatus of claim 1, wherein the correction amount for an image forming position of the second medium is identical to the amount of misalignment calculated for the first medium.

23. The image forming apparatus of claim 2, wherein:

the correction amount for an image forming position of the second medium is calculated by using the following formula in which $0 \leqq Ki < 1$:

Image forming position correction amount of the second medium=medium misalignment amount of the first medium−misalignment amount of the roller from a standard position after the position adjustment of the first medium×Ki.

* * * * *